US005206988A

United States Patent [19]

Piramoon

[11] Patent Number: 5,206,988

[45] Date of Patent: May 4, 1993

[54] HYBRID ULTRA-CENTRIFUGE ROTOR WITH BALANCING RING AND METHOD OF MANUFACTURE

[75] Inventor: Alireza Piramoon, Santa Clara, Calif.

[73] Assignee: Beckman Instruments, Inc., Fullerton, Calif.

[21] Appl. No.: 211,140

[22] Filed: Jun. 22, 1988

Related U.S. Application Data

[63] Continuation of Ser. No. 905,820, Sep. 10, 1986, abandoned.

[51] Int. Cl.[5] ..... B04B 5/04

[52] U.S. Cl. ..... 29/889; 29/557; 29/901; 494/20

[58] Field of Search ..... 29/557, 558, 156.8 R; 74/573 R, 574; 73/66; 198/803.1; 209/199, 541, 542, 543; 435/287; 494/10, 16, 17, 18, 19, 20, 21, 67-69, 76, 77, 82, 85; 241/299

[56] References Cited

U.S. PATENT DOCUMENTS

| | | | |
|---|---|---|---|
| 3,679,130 | 7/1972 | Mayo et al. | 74/573 X |
| 3,762,635 | 10/1973 | Hankey | 494/16 X |
| 4,102,490 | 7/1978 | Chulay | 494/10 |
| 4,126,280 | 11/1978 | Burk | 241/299 X |
| 4,184,524 | 1/1980 | Lorenz | 494/17 X |
| 4,449,966 | 5/1984 | Piramoon | 494/20 |
| 4,611,702 | 9/1986 | Kayakabe et al. | 74/573 R X |

*Primary Examiner*—Irene Cuda

*Attorney, Agent, or Firm*—William H. May; Paul R. Harder; Wen Liu

[57] ABSTRACT

A centrifuge rotor having a balancing ring integrally formed with and raised from the upper surface thereof is manufactured by removing material from the ring to balance the rotor in the upper plane. The balancing ring is on the same radius as the rotor tube cavities and of width less than the diameter of said cavities such that the ring, when the tube cavities are drilled, is broken into segments of precisely known area which make the amount of material to be removed to balance the rotor readily determinable.

10 Claims, 1 Drawing Sheet

HYBRID ULTRA-CENTRIFUGE ROTOR WITH BALANCING RING AND METHOD OF MANUFACTURE

This is a continuation of application Ser. No. 06/905,820, filed Sep. 10, 1986, abandoned.

FIELD OF THE INVENTION

This invention relates to rotors for use in ultra-high speed centrifuges and more particularly to a hybrid vertical tube or fixed angle rotor having a balancing ring thereon and to a method of manufacture of such hybrid rotor.

BACKGROUND OF THE INVENTION

Rotors utilized in ultrahigh speed centrifuges are driven at speeds from about 20,000 rpm up to speeds approaching and exceeding 100,000 rpm's. The balance of such rotors when driven at such speed is obviously very critical. Any imbalance can cause the rotor to become detached from the drive spindle resulting in damage to the rotor and the centrifuge. The lighter the rotor the more critical the balance since the heavier the rotor the greater the downward force and the less tendency for the rotor to "jump-off" the drive spindle because of imbalance. Moreover, any imbalance may repeatedly shut down the centrifuge if it is equipped with an imbalance detection system.

In the past fixed angle and vertical tube ultracentrifuge rotors have been made of isotropic material such as aluminum or titanium. The rotor is cast in a billet and then carefully machined to form the rotor and the test tube cavities are drilled therein. In such rotors it has been the practice to balance the rotor in the lower plane by removing material from the lower surface of the rotor by milling, sanding, machining or filing and in the upper plane to remove material from the outer upper periphery thereof in like manner. Since the rotor typically sets atop its drive spindle, balancing in the upper plane of the rotor is more critical.

High speed hybrid rotors have recently been introduced. Such rotors include a rotor core or body of isotropic material with a reinforcing ring around the outer periphery thereof in the form of a filament wound graphite fiber and epoxy resin ring. In one method of construction the isotropic core is cryogenically cooled to a very low temperature to shrink the core, the ring place around the core body and the combination allowed to return to normal temperature. As the core body returns to room temperature, the core expands against the reinforcing ring thereby prestressing the ring and core body.

Balancing of hybrid type rotors by the conventional method is undesirable in that removal of material from the outer diameter of the core body disturbs the tight tolerances necessary to create the pressure and interference fit between the core body and the reinforcing ring. Further, balancing of the core body prior to assembly with the reinforcing ring does not insure balance of the hybrid rotor combination. Any attempt to balance the rotor in the upper plane by removal of material from the reinforcing ring breaks the fiber filaments damaging the structural integrity of the ring which leads to a reduction in its strength defeating the purpose of the hybrid type rotor.

SUMMARY OF THE INVENTION

A hybrid centrifuge rotor body is disclosed which is made of two primary portions, an isotropic rotor core body and an anisotropic reinforcing ring. Formed in the rotor core body on the upper surface thereof is a balancing ring from which material may be removed to balance the final assembly in the upper plane. The balancing ring may be located any place on the upper surface of the core body but, as is obvious, the farther out on the core radius the ring is located, the less material need be present and less material is required to be removed to balance the rotor under any given conditions. From a practical standpoint, it has been found that the balancing ring should be located in the outer half of the radius and preferably located on the same radius as the tube cavities and should have a width less than the diameter of the tube cavity. This arrangement leaves small segments of a known size making it relatively easy to determine the amount of material to be removed from one or more segments to balance the rotor.

DETAILED DESCRIPTION OF THE PREFERRED EMBODIMENT

Figure 1:
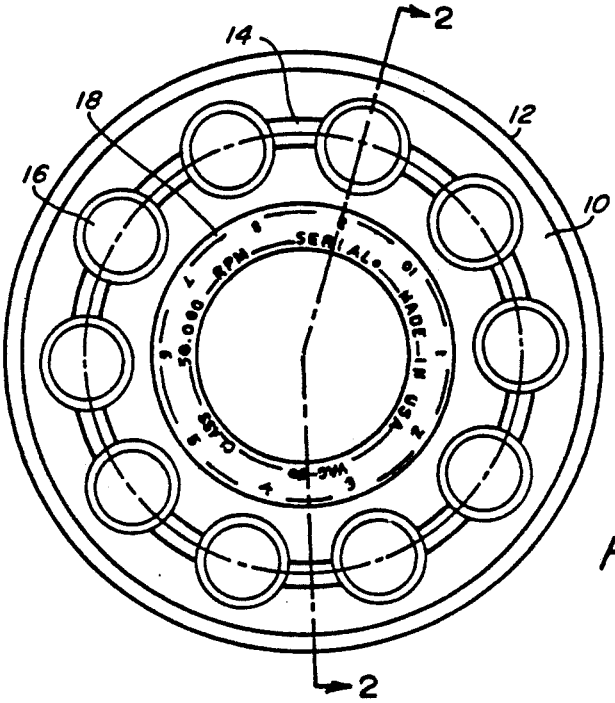
FIG. 1 is a plan view of a hybrid vertical tube centrifuge rotor having a balancing ring on the upper surface thereof.
Figure 2:
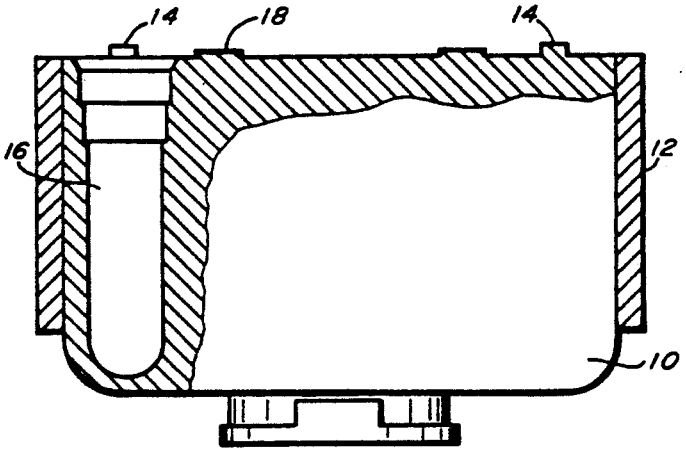
FIG. 2 is an elevation, partially in section, of the rotor of FIG. 1 taken along line 2—2 of FIG. 1.

Referring now to FIGS. 1 and 2 there is illustrated a hybrid vertical tube rotor constructed according to this invention comprising two major components, namely an isotropic rotor core body 10 and an anisotropic reinforcing ring 12 surrounding the body. The core 10 will generally be made of metal such as aluminum or titanium while the reinforcing ring is made of any anisotropic material but preferably is a graphite fiber and epoxy resin filament-wound ring. The construction details of the rotor body and the reinforcing ring are contained in copending application U.S. Ser. No. 6/849,912 filed Apr. 9, 1986 entitled "Hybrid Centrifuge Rotor" and assigned to the assignee of this invention but the details thereof are not essential to an understanding of this invention.

As illustrated in FIGS. 1 and 2 the core body has formed in the upper surface thereof a balancing ring 14 which is an integral part of the body and constitutes a raised surface from which material may be removed for the purpose of balancing the rotor in the upper plane. The balancing ring may be on any core radius but preferably is located on the outer half of the core radius and still more preferably on the same radius as the centrifuge tube cavities 16. The balancing ring may be formed in the same milling operation wherein the upper surface of the billet is flattened and the data pad or ring 18 is formed. The data ring is utilized for stamping or engraving various data such as the rotor serial number, model number and generally its class and maximum rotational speed along with an identification or numbering of the tube cavities. The reasons for the data ring and the details thereof are contained in U.S. Pat. No. 4,102,490.

The balancing ring may be located on any radius along the top of the rotor core but along the tube cavity radius is preferred. It is obvious that the smaller the radius, the greater the amount of material must be removed in order to accomplish any given balancing. To provide this material on a ring of small diameter the width of the ring must be increased or the higher (thicker) the ring must be. The higher the ring, the greater the centrifugal stresses thereon and the greater the chance of flaking along the ring or failure thereof during centrifugation. The greatest amount of stress in the rotor core body is at the outer edge thereof. For this reason, it is somewhat undesirable to locate the ring at the outer periphery although such location is not precluded. In the event that a rotor body includes a data ring 18, it is preferred that the balancing ring be located outside (at a greater radius) of the data ring. It is undesirable to remove material from the data ring because it is generally on a small radius requiring possible removal of enough material to obliterate the data. Stamping or engraving the data after balancing is undesirable since such operation may affect the rotor balance. Further, data rings have typically been raised about 0.025 inches above the rotor surface which does not provide enough material for balancing and at least sections of the data ring would be totally removed.

The balancing ring is preferably located on the same radius as the tube cavities and has a width that is less than the diameter of the tube cavities. The tube holes are precisely located and a precise size and therefore when drilled, cut the balancing ring into small segments the size and location of which are accurately known. Since the surface area of the ring is precisely known as is the density of the core material, the amount of material to be removed from one or more segments may be accurately calculated thus reducing the time and the number of operations necessary for such balancing.

In the past metal rotors were balanced to about 4 gram inches in the upper plane and about 5 gram inches in the lower plane. Because hybrid rotors are substantially lighter, it is desirable to balance them to tolerances of as little as 0.5 gram inches in the upper plane and 1.0 gram inches in the lower plane. Balancing rings located on a tube radius of approximately 3.35 inches and having a height or thickness of 0.050 inches have been found at times to provide insufficient material to balance hybrid rotors to these specifications. Further, with balancing rings having a thickness of 0.070 inches, it has been found necessary to essentially completely remove one or more ring segments to bring the rotor into balance. Of course, the thickness of the ring is somewhat dependent upon the density of the material of the core. It has been found, however, that rings of thickness of about 0.050 inches or more are preferred.

Figure 3:
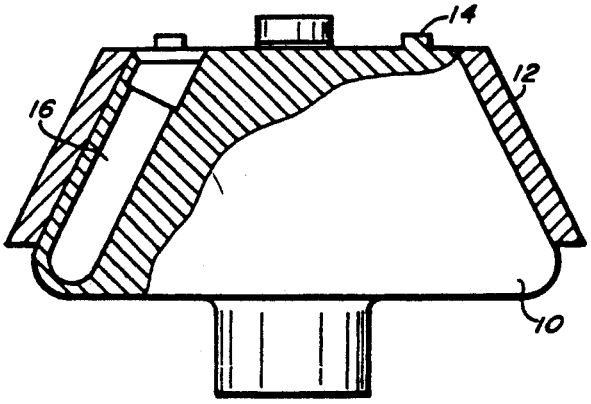
FIG. 3 is an elevation view, partially in section, of a fixed angle hybrid centrifuge rotor, incorporating the balancing ring of this invention.

Illustrated in FIG. 3 is a hybrid fixed angle rotor including a balancing ring located on the tube cavity diameter. For simplicity the data ring is not shown.

While the balancing ring was conceived in connection with the development of a hybrid rotor because conventional upper plane balancing techniques could not be used, its use is not limited thereto but could be used with conventional rotors as well.

There has been illustrated and described a hybrid rotor having a balancing ring integrally formed on the upper surface of the rotor core and preferably located on the same radius as the tube cavities. By removing material from the ring, the rotor may be precisely balanced in the upper plane without affecting the integral strength of the hybrid rotor body.

What is claimed is:

1. A centrifuge rotor having tube cavities formed therein with their centers located along a common radius and a balancing ring integrally formed in and extending above the upper surface of the rotor along said common radius whereby material may be removed from one or more locations along said ring to balance said rotor.

2. In a hybrid centrifuge rotor comprising an isotropic rotor core body having tube cavities formed therein with their centers along a common radius and a reinforcing ring of anisotropic material surrounding said core body, the improvement comprising:

a balancing ring formed in the upper surface of said rotor core body along said common radius, said balancing ring being integrally formed in said body and raised above said surface whereby material may be removed from selected portions of said ring to balance said rotor.

3. In a hybrid centrifuge rotor comprising an isotropic rotor core body having tube cavities formed therein and having their centers located along a common radius and a reinforcing ring of anisotropic material surrounding said core body, the improvement comprising:

a balancing ring formed in the upper surface of said rotor core body along said common radius, said balancing ring being integrally formed in said body and raised from the upper surface of said rotor core body, the height of said raised ring being less in selected areas to balance said rotor.

4. The centrifuge rotor of claim 1 wherein said balancing ring has a width less than the diameter of said tube cavities whereby said balancing ring is formed of small segments of precisely known area such that the amount of material to be removed from one or more segments can be readily determined.

5. The hybrid centrifuge rotor of claim 2 wherein said balancing ring has a width less than the diameter of said tube cavities whereby said balancing ring is formed of small segments of precisely known area such that the amount of material to be removed from one or more segments can be readily determined.

6. The hybrid centrifuge rotor of claim 3 wherein said balancing ring has a width less than the diameter of said tube cavities whereby said balancing ring is formed of small segments of precisely known area such that the amount of material to be removed from one or more segments can be readily determined.

7. The method of manufacturing a hybrid centrifuge rotor having an inner isotropic core body and having tube cavities formed therein with the centers located along a common radius and an outer anisotropic reinforcing ring comprising the steps of:

integrally forming in the upper surface of said rotor core along said common radius a raised balancing ring; and removing material from selected portions of said ring to balance to said rotor.

8. The method of manufacturing hybrid centrifuge rotor as set forth in claim 7 wherein said raised ring has a width less than the diameter of said tube cavities whereby said balancing ring is formed of small segments of precisely known area such that the amount of material to be removed from one or more segments can be readily determined.

9. The method of manufacturing a centrifuge rotor having a body with tube cavities formed therein with their centers located along a common radius and comprising the steps of:

integrally forming in the upper surface of said rotor core along said common radius a raised balancing ring; and removing material from selected portions of said ring to balance to said rotor.

10. The method of manufacturing a centrifuge rotor as set forth in claim 9 wherein said raised ring has a width less than the diameter of said tube cavities whereby said balancing ring is formed of small segments of precisely known area such that the amount of material to be removed from one or more segments can be readily determined.

* * * * *